United States Patent [19]

Hayashi

[11] 4,121,603

[45] Oct. 24, 1978

[54] CONTROL SYSTEM FOR A VENDING MACHINE

[75] Inventor: Yukichi Hayashi, Sakado, Japan

[73] Assignee: Nippon Coinco Co. Ltd., Japan

[21] Appl. No.: 746,802

[22] Filed: Dec. 2, 1976

[30] Foreign Application Priority Data

Dec. 5, 1975 [JP] Japan ..... 50-145276

[51] Int. Cl.[2] ..... G07D 1/06

[52] U.S. Cl. ..... 133/2; 133/4 R

[58] Field of Search ..... 133/1 R, 2, 3 R, 4 R; 194/DIG. 26

[56] References Cited

U.S. PATENT DOCUMENTS 3,795,343 3/1974 Shigemori et al. ..... 194/DIG. 26

3,841,456 10/1974 Levasseur ..... 194/1 N

*Primary Examiner*—Joseph J. Rolla

[57] ABSTRACT

A control system for a vending machine capable of confirming an actual pay-out of change coins. The control system according to the invention includes a paid out coin detection switch which is provided at a location where a change coin driven out by a change pay-out motor passes by and a timer which operates during a predetermined period of time from starting of the change pay-out motor. The actual pay-out of the change coin is confirmed by actuation of the paid out coin detection switch during the operation time of the timer.

3 Claims, 3 Drawing Figures

CONTROL SYSTEM FOR A VENDING MACHINE

This invention relates to a control system for a vending machine and, more particularly, to a control system for controlling paying out of change coins.

A vending machine is generally adapted to calculate the amount of change on the basis of difference between the amount of the inserted coin or coins and a set vend price and perform a series of change pay-out control operation (i.e. vending operation) by substracting the amount which is actually paid out from the set amount of change until the set amount of change is reduced to zero. For detecting the actual pay-out of change coins, a prior art vending machine is so constructed that a cam provided on a shaft of a change pay-out motor is caused to actuate a microswitch for detecting the number of coins paid out as change. This prior art device is defective in that an exact number of paid out change coins cannot be confirmed even though the change pay-out motor is running if a change storage tube is empty or a change coin has stuck in some part of the change pay-out mechanism and is not actually paid out. More specifically, since the output of microswitch actuated by the cam on the change pay-out motor shaft is directly used as a change pay-out detection signal and the amount of change is substracted in response to this signal, a counting circuit in the control system automatically conducts substraction of change and finishes the change pay-out operation even if the change coin actually is not paid out. Thus, the purchaser will suffer an unexpected loss.

It is, therefore, an object of the present invention to provide a control system for the vending machine capable of correctly detecting the number of paid out change coins (i.e. the amount of paid out change). According to the invention, the conventional switch for detecting actuation of the change pay-out motor is eliminated and, instead, a coin detection switch is provided at a location where it can be actuated by a paid out change coin, e.g. in the vicinity of a change coin exit. A flip-flop is set by the coin detection output of this coin detection switch and pay-out of a change coin is confirmed by setting of the flip-flop within a certain period of time after rotation of the change pay-out motor.

The invention will now be described with reference to the accompanying drowings in which.

Figure 1:
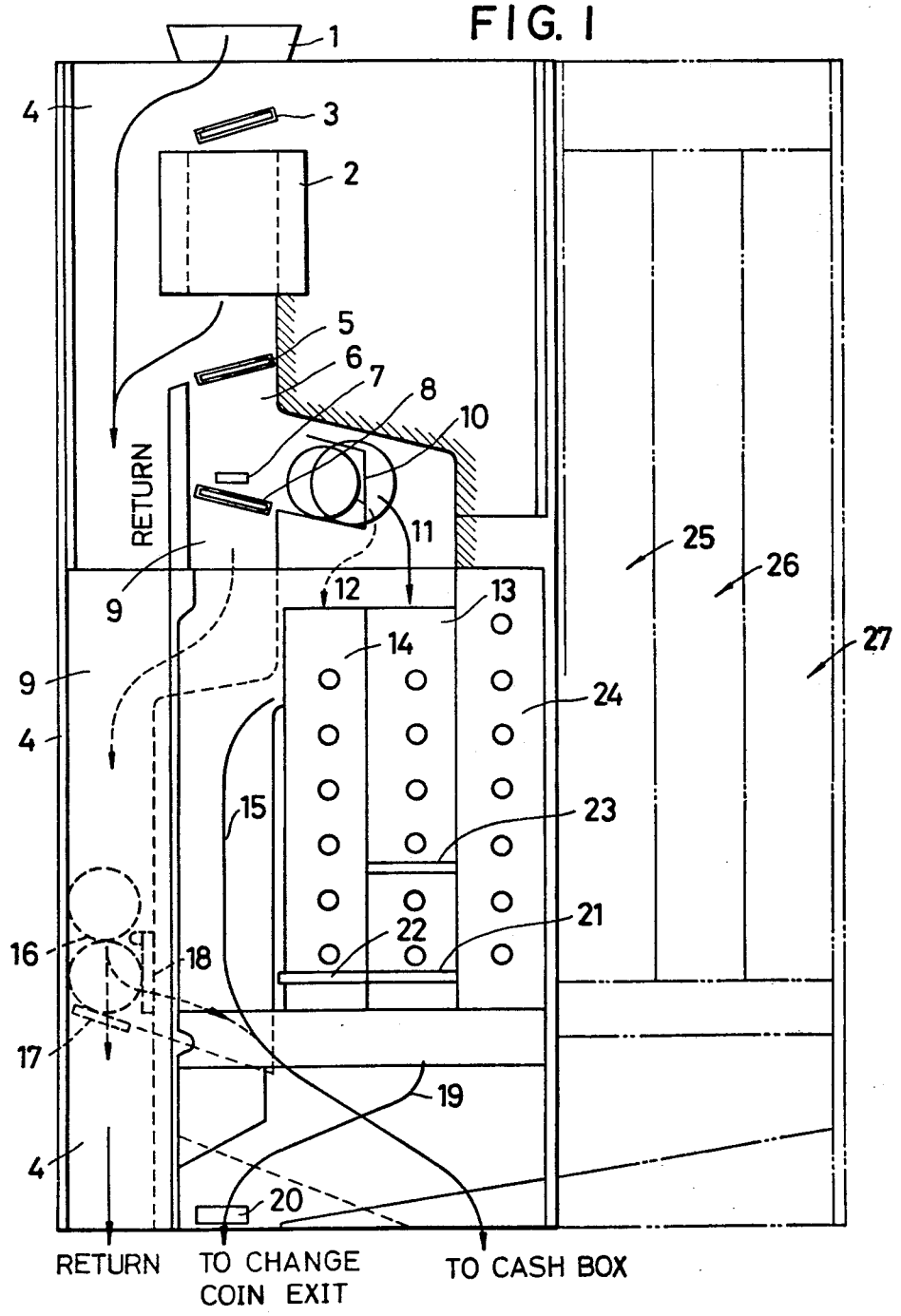
FIG. 1 is a schematic front view of an essential part of a vending machine to which the control system according to the invention is applied.
Figure 3:
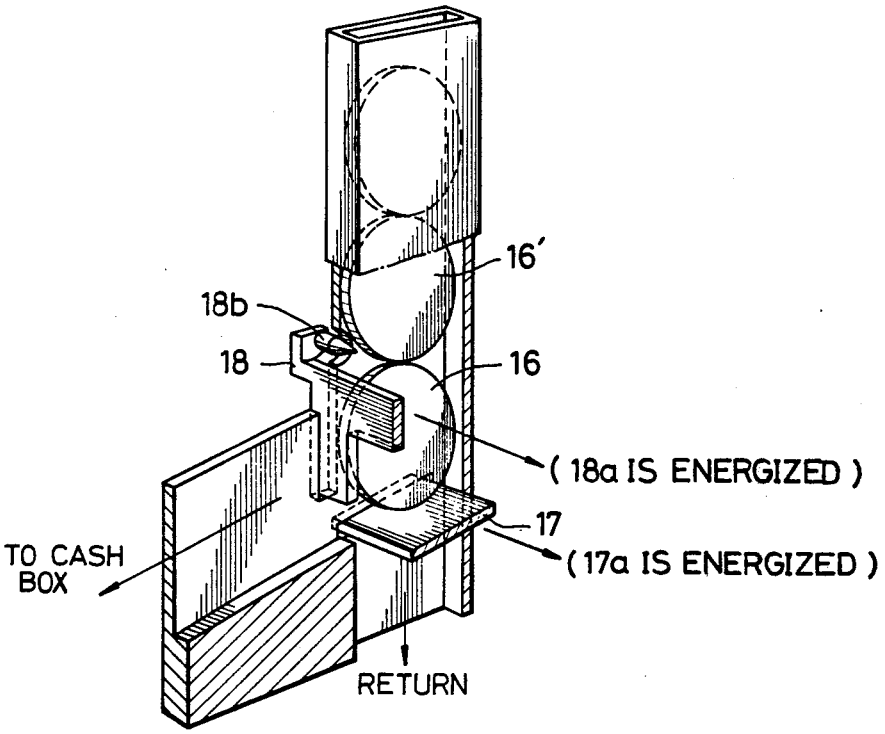
FIG. 3 is an enlarged view showing the escrow device.

Referring first to FIG. 1, the mechanism of the coin device to which the control system according to the invention is applied will be described. A coin inserted through a coin insertion slot 1 is led to a coin checking unit 2 in which whether the inserted coin is a true coin or a false one is checked and the denomination of the coin is identified. As the coin checking unit 2, an electronic type of checking device such as disclosed in the specification of German Patent Application No. P2133725.7 filed July 7, 1971 may be used. A projection 3 provided in the neighborhood of the coin insertion slot 1 is adapted to project to a position above the coin checking unit 2 only during stoppage of electric current and thereby guide the inserted coin into a return path 4. If the inserted coin is found to be a true coin by the output of the coin checking unit 2 as will be described later, a true coin acceptance projection 5 which is normally in a projecting position in a true coin path 6 is withdrawn to let the coin into the true coin path 6. If the inserted coin is a false coin, the projection 5 remains in the projecting position in the true coin path 6 so that the coin is guided to the return path 4. The coin introduced in the true coin path 6 actuates a coin switch 7. If the inserted coin is found to be a 100-yen coin by the coin checking unit 2, a 100-yen coin acceptance projection 8 which is normally projecting in the coin path 6 is withdrawn to let the 100-yen coin into a 100-yen coin path 9. If the inserted coin is not a 100-yen coin, the projection 8 remains in the projecting position and, accordingly, the coin is guided to a 10-yen - 50-yen coin selection section 10 where a 10-yen coin is passed to a 10-yen coin path denoted by arrow 11 and a 50-yen coin to a 50-yen coin path denoted by arrow 12 formed behind the 10-yen coin path 11. The 10-yen coin is then stored in a 10-yen coin storage tube 13 and the 50-yen coin in a 50-yen coin storage tube. The selection of the coin path in the coin selection section 10 is made in accordance with the dimentions of the coin. When the tube 13 or 14 is filled with coins, an overflown coin falls through an overflow coin path denoted by arrow 15 to a coin box (not shown) and stored therein. The 100-yen path 9 is formed behind the return path 4 in such a manner that the inserted 100 yen coins 16 are vertically received one by one as shown in the figure. The 100-yen coin received in the coin path 9 is blocked and temporarily retained by a return projection 17 and an acceptance projection 18 of an escrow device as shown in FIG. 3 provided at the end of the coin path 9. If the 100-yen coin is to be accepted for vending of an article, the acceptance projection 18 is withdrawn to accept the 100-yen coin one by one. When the coin 16 is accepted, an upper coin 16' is held in the position shown in the figure by means of a small projection **18*a*. The accepted 100-yen coin is received in the coin box through the path 15. If there is a 100-yen coin or coins which remain unaccepted (i.e. a coin or coins to be returned as change), the return projection 17 is withdrawn to guide the remaining coin or coins to the return path 4** all at a time.

A pay-out slide (not shown) is provided for each of the coin storage tubes 13 and 14. This pay-out slide is driven by a change coin pay-out motor (not shown) to let the coins fall one by one as the required change. The coin released from the tube 13 or 14 is led to a change coin exit through a change coin pay-out path 19.

The path 15 for storing the coins is formed behind the change coin pay-out path 19. A paid-out coin detection switch 20 is provided in the change coin pay-out path 19 in the vicinity of the change coin exit. This switch 20 is actuated by the change coin which falls from the bottom of the tube 13 or 14 to the change coin exit and thereupon produces a detection output. There are also provided switch (e.g. coils) 21 and 22 in the tubes 13 and 14 for detecting a state in which the number of the change coin stored in each tube has decreased below a predetermined number. Further, a switch (e.g. a coil) 23 is provided above the switch 21 in the 10-yen coin storage tube 13 for detecting a state in which the tube from which the change coin is to be paid out should be replaced by a subsidiary tube.

Subsidiary tubes 24, 25, 26 and 27 are provided for additionally supplying change coins in a case where the change coins stored in the tube 13 are not sufficient for paying the change. More specifically, 10-yen change coins are initially paid from the tube 13 and, when the height of the stored 10-yen coins has become lower than the position of the switch 23, the tube from which the change coins are to be paid out is transferred from the tube 13 to one of the subsidiary tubes 24–27 and further change coins are paid from this subsidiary tube. A control operation for returning the paying out of change coins from the subsidiary tube to the main tube 13 will be described later.

Figure 2:
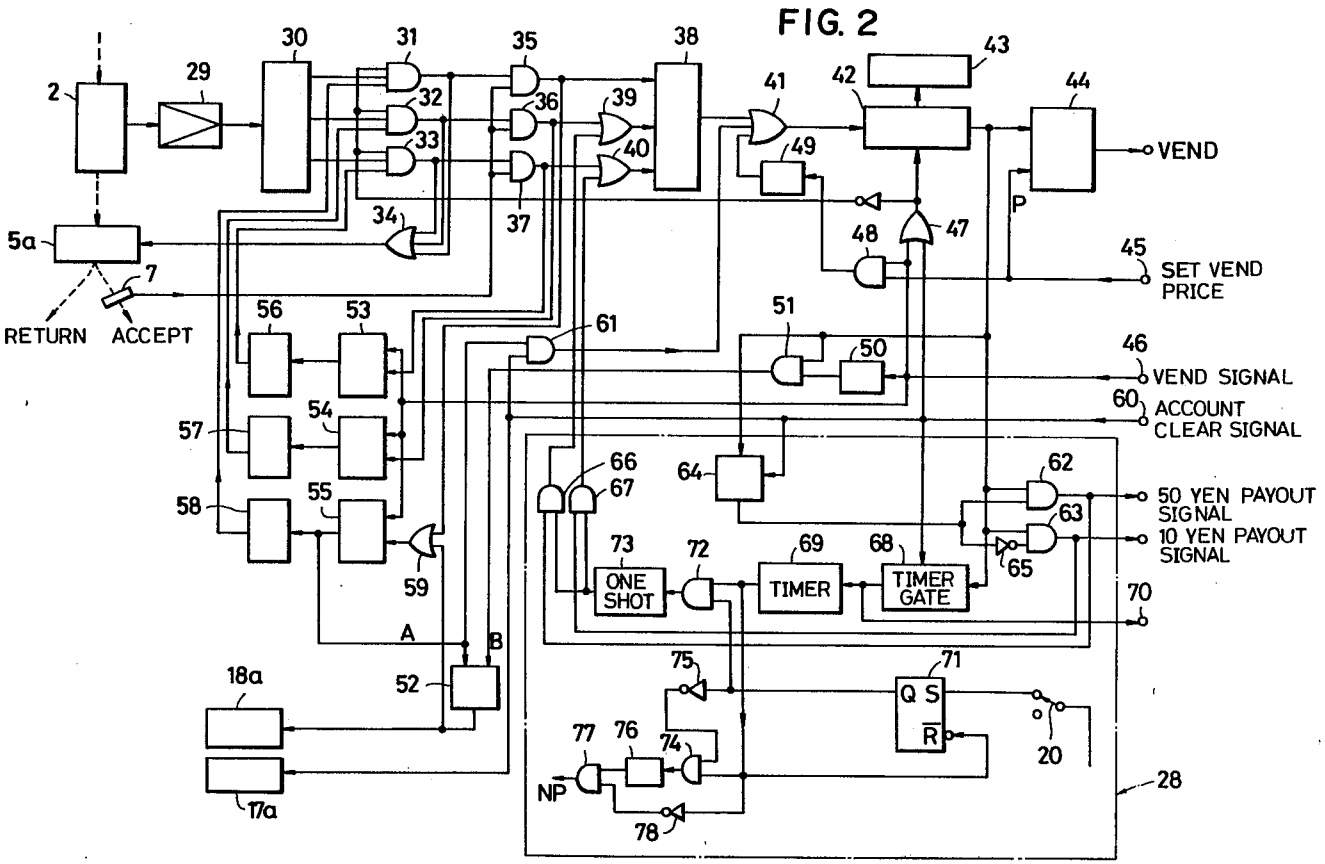
FIG. 2 is a block diagram showing a preferred embodiment of the control system according to the invention.

FIG. 2 is a block diagram showing a preferred embodiment of the inventive control system for the vending machine of a type which is capable of vending plural pieces of an article continuously. The essential portion of the control system according to the invention is a part designated by a reference numeral 28 but the outline of the rest of the portion of the control system will also be described.

The output of the coin checking unit 2 is applied to a discrimination circuit 30 through an amplifier 29 and a result of detection in the circuit 30 is applied to a pertinent one of AND gates 31–33. Namely, a detection output of a 100-yen true coin is applied to the AND gate 31, that of a 50-yen true coin to the AND gate 32 and that of a 10-yen true coin to the AND gate 33. The output "1" of the AND gates 31–33 actuates a control solenoid 5*a* of the true coin acceptance projection 5 (FIG. 1) via an OR gate 34 thereby letting the coin into the coin path 6 (FIG. 1). As the coin actuates the coin switch 7 provided in the coin path 6, a detection output "1" of the switch 7 is applied to AND gates 35–37 and, consequently, an inserted coin detection signal representing the denomination of the inserted coin is supplied to a pulse transducer 38 (via an OR gate 39 or 40 in case of a 50-yen or 10-yen coin). The pulse transducer 38 produces a pulse representing the amount of the inserted coin and applies it to a main counter 42 through an OR gate 41. The main counter 42 counts the amount of the inserted coins. The counted content K of the main counter 42 is indicated by an indicator 43 and also applied to a comparator 44 when it is compared with a set vend amount signal P. If $K \geqq P$ and, accordingly, vending of the article is possible, a vend possible signal VEND is produced by the comparator 44 whereby delivery of a desired article selected in a vender section (not shown) is carried out. When the delivery of the article has been made, a vend signal is applied from the vender section to a terminal 46. This causes a signal "1" to be applied to the main counter 42 through an OR gate 47 thereby bringing the main counter 42 into a subtraction mode. When the output of the OR gate 47 is "0", the counter 42 is in an addition mode. The vend signal also enables the AND gate 48 to pass the set vend amount signal from a terminal 45 to the main counter 42 through a timer 49 and an OR gate 41. The main counter 42 thereupon substracts the set vend amount from the amount of deposited coins. Accordingly, the content of the main counter 42 becomes the remainder of the amount of the deposited coins. When the vend signal is applied to an AND gate 51 after lapse of an operation time $T_2$ of a timer 50, the content of the counter 42 which represents the remainder of the amount of the deposited coins is supplied to a comparator 52 through an AND gate 51. The operation time $T_2$ of the timer 50 is set to be longer than the operation time $T_1$ of the timer 49. Accordingly, the AND gate 51 is enabled after the remainder of the amount is accurately calculated in the main counter 42. Coin counters 53, 54 and 55 provided for counting the number of inserted coins by each denomination respectively count the coin detection pulses by each denomination supplied from the AND gate 35–37. More specifically, the counter 53 counts the number of inserted 10-yen coins, the counter 54 that of inserted 50-yen coins and the counter 55 that of inserted 100-yen coins. The results of counting are supplied to upper limit circuits 56, 57 and 58 corresponding to the respective denominations. Each of the upper limit circuits 56, 57 and 58 provides a corresponding one of the AND gates 31–33 with a signal "0" when the number of the inserted coins has reached a certain predetermined number thereby inhibiting the AND gate for introducing a subsequently inserted coin of the same denomination to the return path 4 (FIG. 1). This control operation is performed for preventing insertion of a larger number of coins than can be treated by the vending machine. The vend signal from the terminal 46 is applied to the 10-yen coin counter 53 and the 50-yen coin counter 54 to reset them. The vend signal is also applied to the 100-yen coin counter 55 to bring it into a subtraction mode. The output of the 100-yen coin counter 55 is applied to the other input terminal of the comparator 52. Designating the content of the counter 55 as A and a signal representing the remaining amount supplied from the AND gate 51 as B, the comparator 52 produces pulses one by one when $A > B$, and stops production of the pulse when $A < B$. The output pulse of the comparator 52 energizes the control solenoid 18*a* of the 100-yen coin acceptance projection 18 (FIG. 1) in the escrow device so as to open the projection 18 each time one shot of the pulse is applied and thereby accept the 100-yen coins one by one. The output pulse of the comparator 52 is also applied through an OR gate 59 to the 100-yen counter 55 which is already in a subtraction mode to cause the counter 55 to subtract the number of the accepted coins from the content thereof. Assuming, for example, that the amount of inserted 100-yen coins is 500 yen and that the set vend amount is 250 yen, three pulses are successively produced by the comparator 52 as shown in the following Table I.

Table I

| A | B | Presence or absence of pulse | |
|---|---|---|---|
| 500 yen | 250 yen | present | time |
| 400 yen | 250 yen | present | ↓ |
| 300 yen | 250 yen | present | |
| 200 yen | 250 yen | absent | |

Accordingly, the content of the counter 55 represents the amount (or the number) of 100-yen coins retained in the 100-yen coin path 9 (FIG. 1) by the escrow device. After the continuous vending operation corresponding to a single coin insertion (and additional coin insertion) effected by the purchaser is completed, the purchaser pushes an account clear button (not shown) and thereupon an account clear signal is applied to a terminal 60. The account clear signal brings the main counter 42 into a subtraction mode through an OR gate 47 and also actuates the return control solenoid 17*a* thereby causing the return projection 17 (FIG. 1) to be withdrawn for returning the 100-yen coin or coins which have been retained by the escrow device. Simultaneously, the account clear signal enables an AND gate 61 to pass a signal representing the count of the counter 55 corresponding to the amount of the returned 100-yen coins to the main counter 42 and thereby cause the main counter 42 to subtract the amount of the returned 100-yen coins from the remaining amount (i.e. the total amount of change) of the main counter 42. The content of the main counter 42 left after subtracting the amount of the returned 100-yen coins represents the amount of change to be paid out in 50-yen coins and 10-yen coins. If the content of the main counter 42 is not "0", the AND gates 62 and 63 are enabled. The content of the main counter 42 is examined by a 50-yen detection circuit 64 and, if the content is 50 yen or more, the circuit 64 produces an output "1", whereas if the content is less than 50 yen, the circuit 64 produces an output "0". The output of the circuit 64 is applied to the AND gate 62 and also to the AND gate 63 after being inverted by an inverter 65. Accordingly, the output "1" of the AND gate 62 constitutes a 50-yen coin pay-out instruction signal whereas the output "1" of the AND gate 63 constitutes a 10-yen coin pay-out instruction signal. Each of these 50-yen coin pay-out instruction signal and 10-yen coin pay-out instruction signal designates the pay-out slide to be moved of a pertinent one of the coin storage tubes 13 and 14. The output "1" of the AND gate 62 enables the AND gate 66 for a 50-yen coin and the output "1" of the AND gate 63 enables the AND gate 67 for a 10-yen coin. On the other hand, the account clear signal is applied to a 100-yen pay-out timer gate 68 to close it during time required for returning all of the retained 100-yen coins by the operation of the solenoid 17*a* and subtracting the amount of the returned coins in the main counter 42. When the timer gate 68 is opened, the main counter 42 has completed the subtraction of the returned 100-yen coins and the timer gate 68 produces a signal "1" if there is a change consisting of a 50-yen coin and/or a 10-yen coin or coins.

The output of the timer gate 68 is applied to a timer 69 and also to a change pay-out motor driving circuit (not shown) via a terminal 70. This causes the change pay-out motor to be driven to pay out a 50-yen coin or a single 10-yen coin as a change. The timer 69 outputs a signal "1" immediately upon receipt of a signal "1" from the timer gate 68, sustaining this output signal "1" during a predetermined operation time $T_3$. The operation time $T_3$ is set in such a manner that it will become equal to a period of time from start of driving of the change pay-out motor till actuation by the paid out coin of the change coin pay-out detection switch 20 (FIG. 1). Accordingly, if the change coin is paid out in a normal way, the change coin pay-out detection switch 20 is actuated during operation of the timer 69, applying a signal "1" to the set input of a flip-flop 71 to set it. The set output of the flip-flop 71 is applied to an AND gate 72. Accordingly, if the change coin is being paid out in a normal way, the signal "1" is produced by the flip-flop 71 while the AND gate 72 is enabled by the output "1" of the timer 69, thereby driving a one shot circuit 73 by the output "1" of the AND gate 72. The one shot circuit 73 produces one shot of pulse upon receipt of the output "1" of the AND gate 72. This one shot of pulse is applied to AND gates 66 and 67. One shot of pulse is applied through one of the AND gates 66 and 67 and one of the OR gates 39 and 40 to the pulse transducer 38. Thereupon a pulse signal representing the amount of the change which has just been paid out is applied to the main counter 42 to enable it to subtract the amount of the paid out change from the content of the counter 42.

The output of the timer 69 is applied to one input of an AND gate 74. The AND gate 74 receives at the other input thereof the inverted output of the flip-flop 71 through an inverter 75. The output of the AND gate 74 is temporarily stored in a temporary memory 76 and thereafter is applied to an AND gate 77. The AND gate 77 also receives the inverted output of the timer 69 through an inverter 78. The AND gate 77 is therfore enabled when the operation time $T_3$ of the timer 69 has ended. If, accordingly, the flip-flop 71 is not set during the operation time $T_3$ of the timer $T_3$, the output of the AND gate 74 is "1". This signal "1" is temporarily stored in the temporary memory 76 and enables the AND gate 77 after the lapse of the operation time $T_3$ of the timer 69 thereby causing the AND gate 77 to produce a signal "1". This signifies that a coin has not been paid out (i.e. the switch 20 has not been actuated) despite the fact that the change coin pay-out motor has been driven. For convenience of explanation, the output "1" of the AND gate 77 will hereinafter be referred to as a change unpaid signal NP. If the change unpaid signal NP is produced while pay-out of a 50-yen coin is being instructed by the output "1" of the AND gate 62, control should be made so that the operation of the pay-out slide is changed over from the tube 14 to the tube 13 (FIG. 1). In this case, the AND gate 67 for a 10-yen coin should be enabled so as to cause the main counter 42 to substract the amount of 10-yen coins from the content of the counter 42.

10-yen change coins are normally paid from the tube 13, If, however, the height of the stored 10-yen coins becomes lower than the position of the switch 23, paying out of 10-yen change coins is transferred to one of the subsidiary tubes 24–27. If the change unpaid signal NP is produced during paying out of ten-yen coins from one of the subsidiary tubes 24–27, the paying out operation is transferred again to the main tube 13. This is because newly thrown-in 10-yen coins are accumulated in the main tube 13 while the subsidiary tube is being used so that the main tube 13 becomes usable again.

If the change unpaid signal NP is produced while 10-yen coins are being paid out from the main tube 13, an abnormal condition signal (e.g. a signal for stopping the operation of the vending machine) is produced. The fact that the main tube 13 is being used signifies that 10-yen coins are stored in the tube 13. Accordingly, non-operation of the switch 20 in that state is considered to mean occurrence of an abnormal condition such as sticking of a coin in the mechanism.

As described in the foregoing, the change unpaid signal NP is utilized for verious control purposes. Further, by adapting the above described control for transferring change pay-out operation from the subsidiary tubes 24–27 to the main tube 13, provision of switches for detecting exhaustion of stored coins in the subsidiary tubes 24–27 can be obviated with a resultant reduction in the manufacturing cost.

The output of the timer 69 is applied to an inverted reset input $\bar{R}$ of the flip-flop 71 so as to reset the flip-flop 71 when the operation time $T_3$ has finished and the signal has fallen from "1" state to "0" state.

The output of the change coin pay-out detection switch 20 is stored in the flip-flop 71 for ensuring application of one shot of pulse to the pulse transducer 38 at each pay-out of a single coin. If the output of the switch 20 was applied directly to the pulse transducer 38, a plurality of pulses could be applied erroneously to the pulse transducer 38 causing an erroneous operation in such an event that a coin to be paid out actuates the switch 20 several times due to rebounding of the coin occurring in the change coin pay-out path or near the change coin exit. Such erroneous operation can be prevented by causing the output of the switch 20 to be stored in the flip-flop 71.

In summary, according to the present invention, a pay-out coin detection switch is provided at a position convenient for accurately detecting actually paid out coins and the output of the detection switch is stored while an operation time which is sufficient for the paid out coin to operate the detection switch is set by a timer. The actual pay-out of the change coin is thus confirmed only when the output of the detection switch 20 is stored during the operation time of the timer. Accordingly, an accurate coin pay-out control operation can be ensured.

What is claimed is:

1. In a control system for a vending machine of a type wherein an amount of change which has been actually paid out is subtracted from a set amount of change to be paid until the set amount of change is reduced to zero, the improvement comprising:

a main counter for successively performing the subtraction of an amount of change which has been actually paid out from the set amount of change, said main counter having an output;

a timer which operates during a predetermined period of time;

means for applying the output of said main counter to said timer for starting the operation of said timer when there is an amount to be cleared from the main counter;

means for applying the output of said main counter to a change payout motor as a drive signal;

a paid out coin detection switch positioned for actuation by a paid out change coin and having a coin detection output;

a memory circuit settable by the coin detection output of said coin detection switch and resettable by ending of the operation time of said timer; and a circuit for producing a pay-out confirmation signal representing that the change coin has been actually paid out when said memory circuit is set during the operation time of said timer.

2. A control system as defined in claim 1 which further comprises:

a plurality of coin tubes from which change is paid;

a circuit for generating a change unpaid signal representing that said paid out coin detection switch was not actuated during the operation time of said timer; and means for effecting replacing one of said coin tubes from which change is to be paid by another upon receipt of the change unpaid signal without disrupting the pay-out procedure.

3. A control system as defined in claim 1 wherein said circuit for producing a pay-out confirmation signal comprises a logic circuit.

* * * * *